US010415816B2

(12) United States Patent
Hagen et al.

(10) Patent No.: US 10,415,816 B2
(45) Date of Patent: Sep. 17, 2019

(54) ILLUMINATED LIQUID VESSEL

(71) Applicant: LIGHT UP THE WORLD LLC, Grand Terrace, CA (US)

(72) Inventors: Darren S. Hagen, Riverside, CA (US); Jim McMinn, Riverside, CA (US)

(73) Assignee: Light Up the World, LLC, Riverside, CA (US)

( * ) Notice: Subject to any disclaimer, the term of this patent is extended or adjusted under 35 U.S.C. 154(b) by 0 days.

(21) Appl. No.: 15/442,853

(22) Filed: Feb. 27, 2017

(65) Prior Publication Data

US 2017/0343206 A1 Nov. 30, 2017

Related U.S. Application Data

(60) Provisional application No. 62/343,813, filed on May 31, 2016.

(51) Int. Cl.

| | |
|---|---|
| ***F21V 33/00*** | (2006.01) |
| ***A47G 19/00*** | (2006.01) |
| *A47G 19/22* | (2006.01) |

(52) U.S. Cl.

CPC ..... *F21V 33/0024* (2013.01); *A47G 19/00* (2013.01); *F21V 33/0008* (2013.01); *A47G 2019/2238* (2013.01)

(58) Field of Classification Search

CPC ..... A47G 2019/2238; A47G 23/0309; A47G 2200/08; A47G 19/025; A47G 23/02; A47G 23/0216; A47G 23/0306; F21S 10/002; F21S 10/00

USPC ..... 362/101

See application file for complete search history.

(56) References Cited

U.S. PATENT DOCUMENTS

| | | | |
|---|---|---|---|
| 2,224,319 | A | 12/1940 | Schroyer |
| 2,532,181 | A | 11/1950 | Moore |
| 2,663,866 | A | 12/1953 | Simpson |
| 3,218,447 | A | 11/1965 | Pardue |
| 3,374,344 | A | 3/1968 | Rudolph et al. |
| 3,878,386 | A | 4/1975 | Douglas |
| 4,344,113 | A | 8/1982 | Ditto et al. |
| 4,563,726 | A | 1/1986 | Newcomb et al. |

(Continued)

FOREIGN PATENT DOCUMENTS

| | | |
|---|---|---|
| AU | 2011904753 | 12/2011 |
| AU | 2012900094 | 2/2012 |

(Continued)

OTHER PUBLICATIONS

International Search Report for PCT/US2017/034976 dated Oct. 2, 2017.

MojoAgua. Product Diagram (online). Nov. 3, 2014. <URL: http://www.mojoagua.com/pdf/MOJO_diagraminfo141029.pdf>

*Primary Examiner* — Tsion Tumebo

(74) *Attorney, Agent, or Firm* — The Myers Law Group

(57) ABSTRACT

An illuminable container device, comprising a housing for containing a liquid; a recess configured within a base area of said housing, with said recess extending upwardly into said housing and in a substantially cylindrical shape; a light device, comprising a light housing with a substantially cylindrical shape, said light housing comprising a plurality of ridges, which are positioned vertically around a circumference of said light housing; said light device configured to fit into and substantially fill said recess being held therein by a pressurized fit.

13 Claims, 12 Drawing Sheets

(56) References Cited

U.S. PATENT DOCUMENTS 4,886,183 A 12/1989 Fleming
4,922,355 A 5/1990 Dietz et al.
5,119,279 A 6/1992 Makowsky
5,178,450 A 1/1993 Zelensky et al.
5,211,699 A 5/1993 Tipton
5,339,548 A 8/1994 Russell
5,504,663 A 4/1996 Tucker
5,662,406 A 9/1997 Mattice et al.
5,680,958 A * 10/1997 Mann ..... A45F 3/14 220/739
5,743,620 A * 4/1998 Rojas ..... A47G 19/2227 215/386
5,785,407 A 7/1998 Ratcliffe et al.
5,879,068 A 3/1999 Menashrov et al.
5,990,790 A 11/1999 Lusareta
6,062,380 A 5/2000 Dorney
6,065,848 A 5/2000 Tucker et al.
6,086,216 A * 7/2000 Goldfarb ..... F21V 33/00 362/101
6,092,905 A 7/2000 Koehn
6,163,248 A 12/2000 Paek et al.
6,213,616 B1 4/2001 Chien
6,241,359 B1 6/2001 Lin
6,254,247 B1 7/2001 Carson
6,283,605 B1 9/2001 Kalamaras
6,286,719 B1 9/2001 Haines
6,371,624 B1 4/2002 Dorney
6,379,018 B1 * 4/2002 Rycroft ..... A47G 23/0309 362/101
6,419,384 B1 7/2002 Lewis et al.
6,443,589 B1 * 9/2002 Lee ..... A47G 19/2227 362/101
6,505,734 B2 1/2003 Su
6,511,196 B1 1/2003 Hoy
6,511,197 B1 1/2003 Kalemjian
6,527,110 B2 * 3/2003 Moscovitz ..... B65D 51/2835 206/222
6,553,696 B1 4/2003 Foster, Sr.
6,619,811 B2 9/2003 Wang et al.
6,676,269 B1 1/2004 Dorney
6,739,731 B2 * 5/2004 Katzman ..... B65D 23/14 206/219
6,746,132 B2 6/2004 Liu
6,762,734 B2 7/2004 Blotky et al.
6,786,614 B2 9/2004 Ciarrocchi, Jr.
6,793,362 B2 9/2004 Tai
6,796,671 B2 9/2004 Rudell et al.
6,824,289 B2 11/2004 Vanderschuit
6,874,906 B1 4/2005 Dorney
6,921,179 B2 7/2005 Diak Ghanem
6,923,549 B2 8/2005 Hoy
6,945,393 B2 * 9/2005 Cho ..... B65D 51/24 206/219
6,955,443 B2 10/2005 Solowiej
6,964,492 B1 11/2005 Nicklowitz
6,971,562 B2 * 12/2005 Willows ..... A45F 3/16 224/148.4
7,018,062 B2 3/2006 Taylor
7,049,766 B2 5/2006 Lewis et al.
7,063,432 B2 6/2006 VanderSchuit
7,163,304 B2 1/2007 Cohen et al.
7,175,294 B1 2/2007 Estrada et al.
7,229,181 B2 6/2007 Diak Ghanem
7,232,237 B2 6/2007 Bigger
7,309,136 B2 12/2007 Lei
7,311,412 B2 12/2007 Ichikawa
7,318,656 B1 1/2008 Merine
7,341,167 B2 3/2008 Mochiachvili et al.
7,384,164 B2 6/2008 Yu
7,401,935 B2 7/2008 VanderSchuit
7,452,096 B2 11/2008 Ichikawa
D582,775 S * 12/2008 Pedmo ..... D9/516
7,465,058 B1 12/2008 Lopez
7,510,292 B2 3/2009 Ichikawa
7,674,001 B1 3/2010 Ferrin et al.
7,726,830 B2 * 6/2010 Yang ..... B44C 5/005 362/101
7,740,368 B2 6/2010 Chiang
7,762,682 B2 7/2010 Yang
7,771,073 B2 8/2010 Chen
7,845,815 B2 12/2010 Yu et al.
7,914,165 B2 3/2011 Bertken
7,954,970 B2 6/2011 Goldburt
7,976,177 B2 * 7/2011 Dikopf ..... A47G 19/2227 206/457
8,011,816 B1 9/2011 Janda
8,087,809 B2 1/2012 Tikhman et al.
8,152,321 B2 4/2012 Lindholm
8,353,604 B2 1/2013 Glazier
8,403,512 B2 3/2013 Chang
8,485,680 B2 7/2013 Anderson et al.
8,534,862 B2 9/2013 Simon et al.
8,585,264 B2 11/2013 Robbins
8,770,775 B2 7/2014 Abro et al.
8,770,776 B1 7/2014 Yang
8,777,440 B2 7/2014 Eves
8,814,379 B2 8/2014 Griffiths et al.
8,820,954 B2 9/2014 Horn et al.
8,919,981 B2 * 12/2014 Wang ..... A47G 19/2227 362/101
9,010,952 B2 4/2015 Lenahan et al.
9,010,953 B1 4/2015 Wells
9,055,832 B2 6/2015 Regan
9,545,166 B2 1/2017 Wells
9,592,940 B2 * 3/2017 Nyambi ..... B65D 47/243
9,593,841 B2 * 3/2017 Sutton ..... F21V 33/0024
9,604,765 B2 * 3/2017 Besic ..... B65D 51/2828
D798,145 S * 9/2017 Komai ..... D9/428
2002/0159247 A1 * 10/2002 Katzman ..... B65D 23/14 362/101
2003/0063460 A1 4/2003 Nadel
2003/0076671 A1 4/2003 Diak/Ghanem
2003/0076672 A1 * 4/2003 Head ..... A47G 23/0309 362/101
2003/0132244 A1 * 7/2003 Birkmayer ..... B65D 41/3442 222/83
2003/0147234 A1 8/2003 Harada et al.
2004/0004829 A1 1/2004 Policappelli
2004/0017678 A1 * 1/2004 Liu ..... A47G 19/2227 362/101
2004/0264171 A1 12/2004 King et al.
2005/0007773 A1 1/2005 Austin
2005/0024851 A1 2/2005 Lee
2005/0024858 A1 2/2005 Johnson
2005/0207141 A1 9/2005 Boesch et al.
2006/0061985 A1 3/2006 Elkins
2006/0109644 A1 5/2006 Saucier, Sr. et al.
2006/0139928 A1 6/2006 Griffiths et al.
2007/0014100 A1 1/2007 Perez et al.
2007/0171627 A1 7/2007 Hsu
2007/0183140 A1 8/2007 Lusker
2007/0201220 A1 8/2007 Ulicny
2007/0206372 A1 9/2007 Casillas
2008/0035515 A1 2/2008 Dikopf
2008/0130266 A1 * 6/2008 DeWitt ..... A61L 9/03 362/96
2008/0198576 A1 8/2008 Eliaz et al.
2008/0317906 A1 12/2008 Goldburt
2009/0122523 A1 5/2009 Rycroft
2009/0212059 A1 8/2009 Chen
2009/0242561 A1 * 10/2009 Wellman ..... B65D 51/2828 220/277
2009/0321458 A1 12/2009 Blair
2010/0124048 A1 5/2010 Winters
2010/0157579 A1 6/2010 Kononuk
2010/0163516 A1 7/2010 Paine
2011/0011873 A1 * 1/2011 Miura ..... B65D 1/0284 220/609
2011/0228518 A1 9/2011 Vagnby
2012/0273372 A1 11/2012 Goldburt et al.
2013/0271963 A1 10/2013 Zalon
2014/0185277 A1 7/2014 Mongeli

(56) References Cited

U.S. PATENT DOCUMENTS

| | | | |
|---|---|---|---|
| 2014/0268666 | A1 | 9/2014 | Bretschneider |
| 2014/0300273 | A1 | 10/2014 | Lebrun et al. |
| 2015/0092396 | A1 | 4/2015 | Jordan |
| 2015/0159822 | A1 | 6/2015 | Mohr |
| 2015/0267913 | A1 | 9/2015 | Schrimmer |
| 2015/0292729 | A1 | 10/2015 | Sutton |

FOREIGN PATENT DOCUMENTS

| | | |
|---|---|---|
| AU | 2012900260 | 2/2012 |
| AU | 2012901772 | 5/2012 |
| AU | 2012904083 | 10/2012 |
| AU | 2012904376 | 10/2012 |
| AU | 2012904377 | 10/2012 |
| AU | 2012904553 | 11/2012 |
| AU | 2013203098 | 7/2013 |
| AU | 2013204141 | 4/2014 |
| AU | 2015227432 | 10/2015 |
| EP | 1237167 | 8/2004 |
| EP | 1237167 | 8/2014 |
| WO | WO 2004/110892 | 12/2004 |
| WO | WO 2006/081257 | 8/2006 |
| WO | WO 2007/095569 | 8/2007 |
| WO | WO 2007/106125 | 9/2007 |
| WO | WO 2010/058300 | 5/2010 |
| WO | WO 2013/063651 | 5/2013 |
| WO | WO 2013/104016 | 7/2013 |
| WO | WO 2013/173953 | 11/2013 |
| WO | WO 2014/043752 | 3/2014 |

* cited by examiner

SECTION A – A

ILLUMINATED LIQUID VESSEL

PRIORITY CLAIM

This applications claims the priority date of provisional application No. 62/343,813 filed on May 31, 2016, which is herein incorporated by reference in its entirety.

BACKGROUND

The present disclosure relates generally to an illuminated liquid vessel, and more particularly, illuminating a liquid filled vessel, such as a water bottle, through the use of sturdy, compact, and customized snap-in and pressure fit lighting features.

Illuminated containers are often used as a novelty item for various entertainment purposes, such as concerts, parties, sporting events, and other social or themed events. However, the durability, versatility, and longevity of the illuminated containers are often diminished by sub-par lighting and bottle components as well as ineffective methods of manufacture and connectivity of said lighting and bottle components. An apparatus is needed to improve the durability, longevity and effectiveness of illuminating liquids within various drinking vessels and other containers for liquids.

SUMMARY

An illuminable container device, comprising a housing for containing a liquid; a recess configured within a base area of said housing, with said recess extending upwardly into said housing and in a substantial dome shape; wherein said recess comprises a plurality of sub-recesses situated around a circumference area of said recess and that are concave in shape and extend laterally into said housing; a light device, comprising a light housing that is substantially cylindrical in shape with a miniature dome situated at a center of a top area of said light device; said light housing comprising a plurality of ribs situated around a circumference of said light housing; and said plurality of ribs are convex in shape and configured to fit within said plurality of sub-recesses of said recess.

An illuminable container device, comprising a housing for containing a liquid; a recess configured within a base area of said housing, with said recess extending upwardly into said housing and in a substantially cylindrical shape; a light device, comprising a light housing with a substantially cylindrical shape, said light housing comprising a plurality of ridges, which are positioned vertically around a circumference of said light housing; said light device configured to fit into and substantially fill said recess being held therein by a pressurized fit.

A wearable illuminable container device, comprising a housing for containing a liquid; a recess configured within a base area of said housing, with said recess extending upwardly into said housing and in a substantially cylindrical shape;

a light device, comprising a light housing with a substantially cylindrical shape, said light housing comprising a plurality of ridges, which are positioned vertically around a circumference of said light housing, said plurality of ridges being curved in nature; and a lanyard configured to couple around said device by an adjustable multi-prong securing element.

DESCRIPTION OF THE PREFERRED EMBODIMENTS

The detailed descriptions set forth below in connection with the appended drawings are intended as a description of embodiments of the invention, and is not intended to represent the only forms in which the present invention may be constructed and/or utilized. The descriptions set forth the structure and the sequence of steps for constructing and operating the invention in connection with the illustrated embodiments. It is to be understood, however, that the same or equivalent structures and steps may be accomplished by different embodiments that are also intended to be encompassed within the spirit and scope of the invention.

Figure 1:
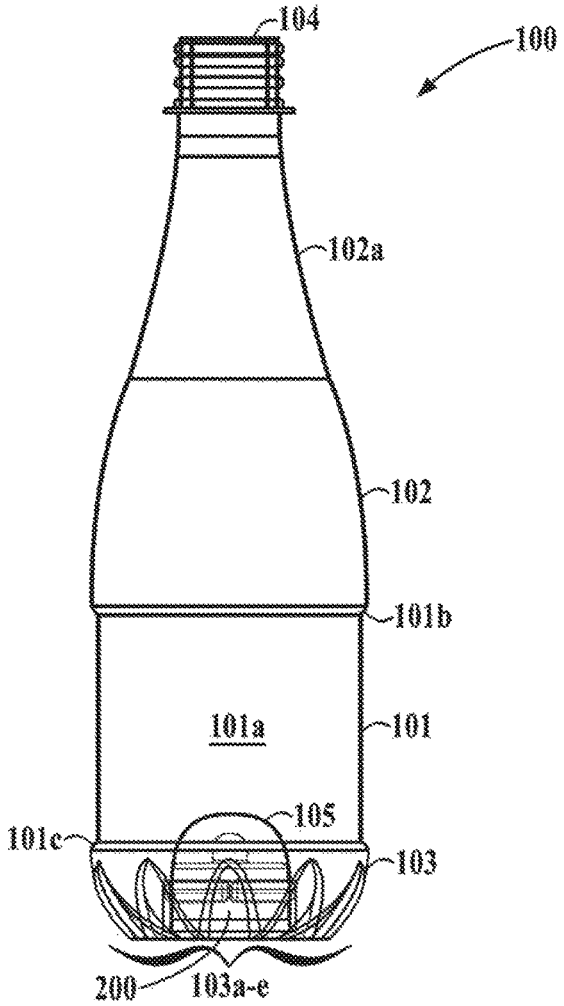
FIG. 1 illustrates a perspective view of an example illuminated liquid vessel, with a lighting element configured within an umbrella cavity of the vessel, in accordance with one embodiment.

FIG. 1 illustrates a perspective view of an example illuminated liquid vessel (100), with a lighting element (200) configured within a recess, or cavity (105) of the illuminated liquid vessel, in accordance with one embodiment. The illuminated liquid vessel (100) is intended to represent various forms of drinking vessels and beverage containers, such as water bottles, alcoholic beverage containers, beverage dispensers, multi-gallon containers, and other similar liquid containing vessels. Such liquid vessels may be configured to hold carbonated or non-carbonated liquids, and liquids of varying levels of alcohol content. In an example embodiment, liquid vessel (100) may have an approximate height of 9.021 inches and the capability to hold approximately 16.9 ounces of liquid. Other heights, sizes, and ounce capacity may be used in connection with vessel (100) in accordance with the scope of the present disclosure.

In an example embodiment, liquid vessel (100) may be made of a clear plastic composition commonly known in the art, and comprising an approximate total mass composition of approximately 28 mL for purposes such as durability and strength, and that may be uniform in thickness of composition. The plastic composition for liquid vessel (100) may also be comprised of polyethylene terephthalate, or also known as "PET," for purposes such as reuse or recycling of the liquid vessel, and are known to a person of ordinary skill in the art. Liquid vessel (100) may also be composed of other plastic composition types, such as translucent materials, and may also contain differing total mass compositions of plastic without deviating from the scope of the present invention. Yet further, liquid vessel (100) may be composed of other known bottle and container materials, such as aluminum, recycled materials, as well as combinations of different materials, such as plastic and aluminum.

In the exemplary embodiment, illuminated liquid vessel (100) may be comprised of a generally cylindrical body portion (101), a shoulder portion (102), a neck portion (102*a*), base portion (103), and a mouth (104). The body (101) may further be comprised of an indented panel segment (101*a*) that is situated around the circumference of the body (101) and may be used for such purposes including enhanced light projection as well as for labels (not shown), marketing, branding, and decorative aspects that may be applied or used in connection with the illuminated liquid vessel (100). For example, indented panel segment (101*a*) may contain a label wrapped around it with branding, sponsorship, and content information. In another example, the label for indented panel segment (101*a*) may contain a hologram imprint that may reflect outside vessel (100) when light element (200) is activated.

Segment (101*a*) may further be comprised of a top and a bottom slanted ridge ((101*b*) and (101*c*), respectively), which are also situated around the circumference of the body (101), and contiguous with segment (101*a*). Top ridge (101*b*) may be configured to slant inward in angular direction from the shoulder (102) and toward segment (101*a*), whereas bottom ridge (101*c*) may be configured to slant away in angled from base (103), and toward the segment (101*a*). In one embodiment, ridges (101*b*) and (101*c*) may be angled at approximately 45 degrees.

Situated above body (101) is the shoulder portion (102), which is slightly curved upward toward neck portion (102*a*). Neck portion (102*a*) is situated above shoulder (102) and is generally narrower is width and circumference that the other portions of vessel (100). In the exemplary embodiment, neck portion (102*a*) is elongated in height for such purposes as, and including, but not limited to, enhancing the lighting effect for vessel (100). Situated at the top area of neck (102*a*) is the mouth (104). Mouth (104) may comprise a narrow cylindrical shape with an opening at its top end to allow a user of the vessel (100) to drink or otherwise utilize the contents of vessel (100). When vessel (100) is not in used, mouth (104) may be covered by a cap piece containing internal threading (not shown) that may be coupled to threading that is proximate mouth (104) (as shown in FIG. 1).

Situated below body (101) is base portion (103) containing a plurality of curved indentations there within (103 *a, b, c, d*, and *e*, respectively) (See FIG. 3 for additional detail and illustration) situated adjacent to each other in a generally equidistance manner around the circumference of the base (103). Also situated within base (103) is a cavity (105), which may be dome shaped in an example embodiment, and configured to hold light element (200) via a snap-in mechanisms (explained in further detail with respect to FIGS. 4-10).

Figure 2:
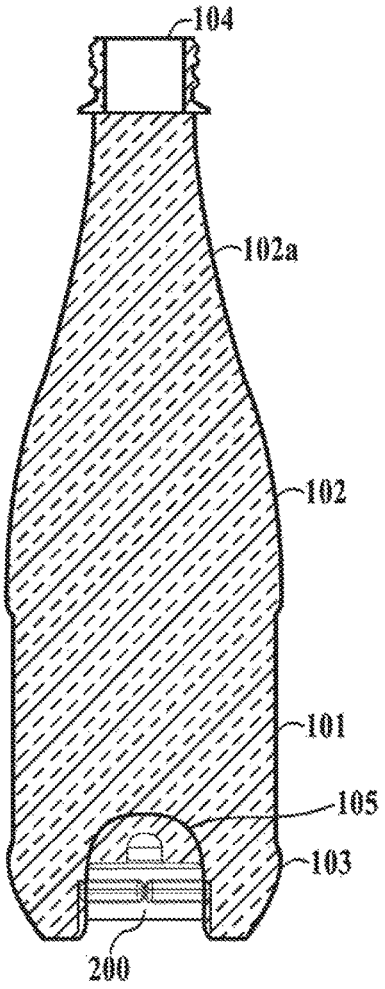
FIG. 2 depicts a cross-section view of an example illuminated liquid vessel, with a lighting element configured therein, in accordance with one embodiment.

FIG. 2 illustrates a cross-section view of an example illuminated liquid vessel (100) showing light element (200) configured therein, in accordance with one embodiment. In this view, the outline of light element (200) is shown when it is placed and situated within cavity (105). Light element (200) may further comprise a light housing (201), which encloses and contains the internal lighting components (not shown) of light element (200) (See FIGS. 5A-D for additional details). Also shown in this view, a base portion (203) of light element (200) may sit flush with and level with a center base area (106) (not shown) of liquid vessel (100), which is generally surrounded by indentations (103*a*), (103*b*), (103*c*), (103*d*), and (103*e*). Base portion (203) may be situated at a height elevated above feet (103*a-e*), or generally at the same level as feet (103*a-e*), so as not to interfere with the stability and placement of liquid vessel (100) when placed upon a flat or other similar surface.

Figure 3:
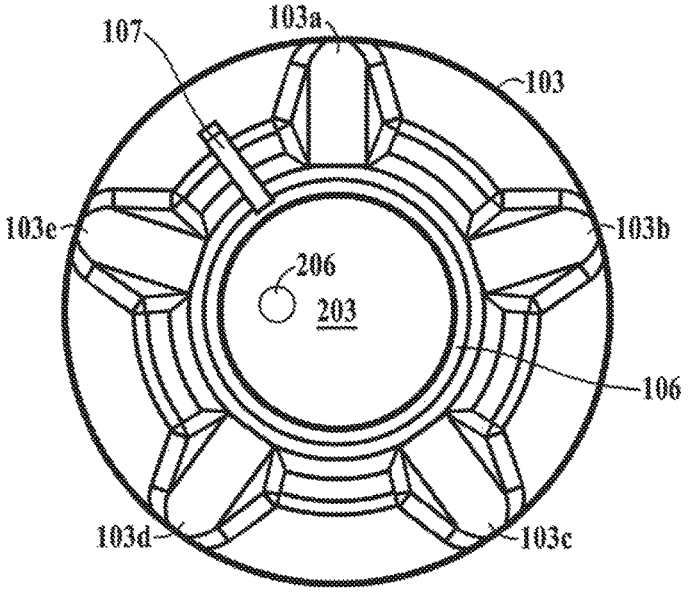
FIG. 3 depicts a bottom plan view of an example illuminated liquid vessel, with a lighting element configured therein, in accordance with one embodiment.

FIG. 3 illustrates a bottom plan view of an example illuminated liquid vessel (100) with light element (200) configured therein, in accordance with one embodiment. In this view, the base (203) of light element (200) is shown as it may be enclosed and placed within cavity (105). As mentioned earlier, surrounding center base area (106) are indentations (103*a, b, c, d*, and e) positioned adjacent to each other in a substantially equidistance manner around the circumference of base (103). The positioning of indentations (103*a, b, c, d*, and e) may generally provide support for bottling conditions for certain types of liquids, such as carbonated liquids. Center base area (106) may provide central support for the remaining portion of base (103), and may contain an opening or entry area to configure light element's (200) placement into cavity (105). Also shown in this figure is a tooling gap (107), which in this view is positioned between the middle area of (103*a*) and (103*b*), but which may be positioned between any of (103*a, b, c, d*, or *e*) in accordance with the scope of the present disclosure.

Tooling gap (107) may be comprised of a small, narrow passage way that may be generally rectangular in shape without detracting from the overall style and aesthetic of vessel (100). The narrow passage way of tooling gap (107) may provide a sufficient amount of space within base (103)

for a tool, such as a screwdriver, elongated pin, or other similar tool to be inserted there within for purposes of engaging with the base (203) and removing light element (200) from liquid vessel (100) when needed or desired. In certain instances, tooling gap (107) may be utilized to remove light element (200) for such purposes, including, but not limited to, replacing light element (200) with a new or alternate light, or before liquid vessel (100) is sent for recycling.

Figure 4:
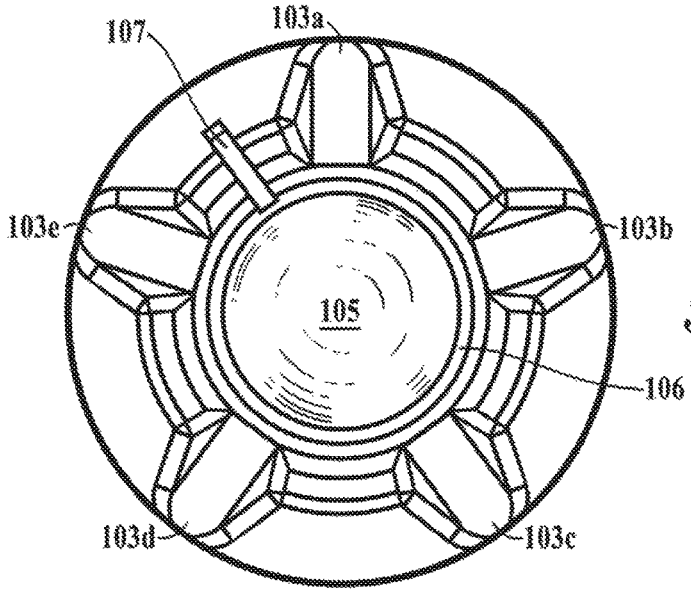
FIG. 4 depicts a bottom plan view of an example illuminated liquid vessel, without a lighting element configured therein, in accordance with one embodiment.

FIG. 4 depicts a bottom plan view of an embodiment of an illuminated liquid vessel (100) without a light element (200) configured therein, in accordance with one embodiment. Similar to FIG. 3, the view in FIG. 4 depicts the additional components of base (103), such as indentations (103*a, b, c, d*, and e), base center area (106), and tooling gap (107). In this view, cavity (105) and the circular opening of base center area (106) are depicted from below and further illustrate the inner dome shape of cavity (105) from another view.

Figure 5A:
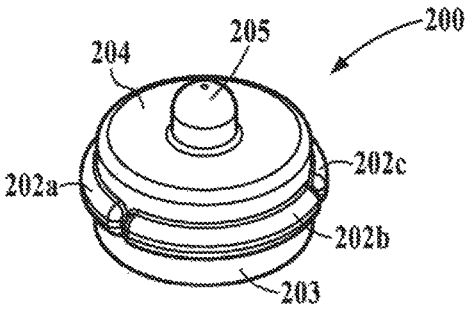
FIG. 5A depicts a perspective view of an example lighting element for an illuminated liquid vessel, in accordance with one embodiment.

FIG. 5A depicts a perspective view of a light element (200) for use with liquid vessel (100), in accordance with one embodiment. As previously mentioned, light element (200) may be comprised of housing (201), which may encapsulate and contain all of the internal components of light element (200). In the present embodiment, housing (201) may be formed of a rigid plastic material to provide, among other aspects, enhanced protection to the internal components of light element (200).

Situated at the uppermost area of housing (201) is a light dome (205) where the bulb or lighting element of the internal components of light element (200) may be positioned within housing (201). In the exemplary embodiment, light dome's (205) shape allows for light to be reflected into liquid vessel (100) at an enhanced or a maximum level of dispersion therein. The material used to form housing (201) may also be employed to provide other protective qualities to light element (201), such as waterproof qualities, and to withstand handling, vibrations, and other impacts that may be caused by a user or other handling. Additionally, other comparable materials may be employed as the material used to form housing (201) without deviating from the scope of the present disclosure. In an exemplary embodiment, housing (201) may be formed from a single injection molding process, and which may enhance the creation of housing (201) as a uniform component with a smooth curved surface.

Situated around the horizontal circumference of housing (201) are ribs (202*a*), (202*b*), and (202*c*). In the present embodiment, the overall body of ribs (202*a-c*) are generally rounded and convex in shape, and in one embodiment, may have approximate dimensions of 2.1 millimeters in thickness along substantially all of the curvature of the body portion of each of ribs (202*a-c*), and are the same dimensions in size with each rib (202*a-c*) wrapping around approximately one-third (⅓) of the circumference of housing (201). Each end of ribs (202*a*), (202*b*), and (202*c*) may be generally rounded or curved and tapered off in shape. Ribs (202*a-c*) may also provide additional reinforcement and support to housing (201). The overall shape of each of ribs (202*a-c*) are configured to fit securely within the cavity (105) of liquid vessel (100) via a plurality of complementary shaped spaces within cavity (105) (not shown in this figure). As will be discussed in detail below, cavity (105) may be further comprised of a plurality of sub-recesses, or rib enclosures (105*a-c*), which are generally concave in shape and preformed to fit around or complement each of ribs (202*a-c*).

Figure 5B:
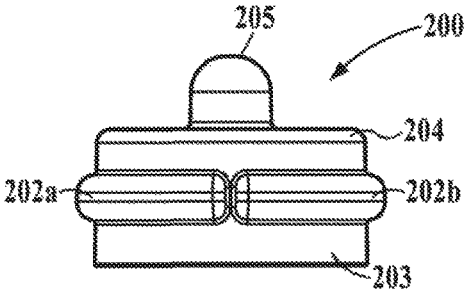
FIG. 5B depicts a side view of an example lighting element for an illuminated liquid vessel, in accordance with one embodiment.

FIG. 5B depicts a side view of an exemplary light element (200) for liquid vessel (100), in accordance with one embodiment. In this view, two of the ribs, (202*a*) and (202*b*), may be positioned centrally between a base area (203) and a top area (204) of housing (201). In an exemplary embodiment, the dimension of light element (200) may be as follows: approximately 15 millimeters in height from base (203) to top (204), or approximately 23 millimeters in height from base (203) to the top height of light dome (205) of light element (200); the diameter of light element (200) measuring at the base (203) only may be approximately 29.9 millimeters, while the length of light element (200), including the width of ribs (202*a-c*) may measure approximately 33.8 millimeters in total length. In one embodiment, base (203) of light element (200) may be sonic welded to housing (201) to prevent the entry of water and other elements into light element (200).

Figure 5C:
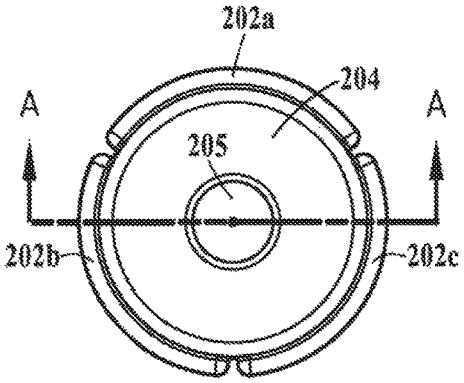
FIG. 5C depicts a top view of an example lighting element for an illuminated liquid vessel, in accordance with one embodiment.

FIG. 5C depicts a top view of an example light element (200) for liquid vessel (100), in accordance with one embodiment. In this view, the curvature, length, width, and positioning of ribs (202*a*), (202*b*), and (202*c*) can be seen, including a small gap of space separating each of ribs (202*a-c*). In one embodiment, the small gap between each of ribs (202*a-c*) may be approximately 1.1 millimeters. As mentioned earlier, each of ribs (202*a-c*) cover substantially all of the circumference of light element (200). Also shown in this view is light dome (205), and as indicated above, the shape of light dome (205) allows for light to be reflected into liquid vessel (100) via cavity (105) at an enhanced level with a maximum level of dispersion. The shape of light dome (205) may resemble in shape a conical or curved bullet head, or other similar shape, without deviating from the scope of the present disclosure, and for purposes of enhancing the lighting effect of light element (200) in liquid vessel (100).

Figure 5D:
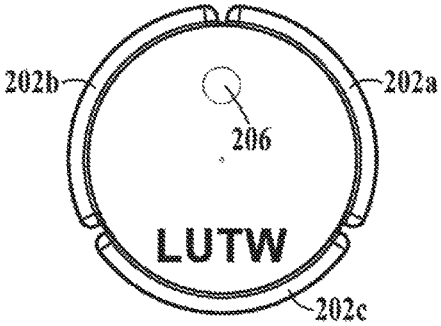
FIG. 5D depicts a bottom view of an example lighting element for an illuminated liquid vessel, in accordance with one embodiment.

FIG. 5D depicts a bottom view of an example light element (200) for liquid vessel (100) in accordance with one embodiment. In this view, button (206) is shown, which may be utilized by a user of liquid vessel (100) to turn on or activate the internal components of light element (200) in order to illuminate liquid vessel (100). In the example embodiment, button (206) may have approximate dimensions of 7.5 millimeters in diameter and 4 millimeters in height, and may sit flush with base (103) of liquid vessel (100) or may be positioned at a height slightly higher than indentations (103*a, b, c, d*, and e). Button (206) may be large enough in size or diameter to easily accommodate when a user engages button (206) to activate light element (200), providing user friendly access as well as to prevent the loss or damage to button (206).

Figure 6:
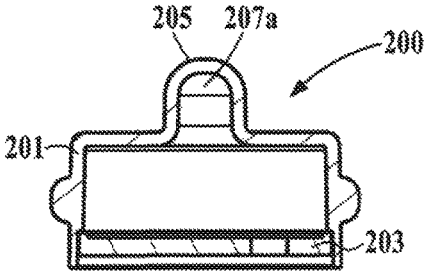
FIG. 6 depicts a side cross-section view of a lighting element for an illuminated liquid vessel, in accordance with one embodiment.

FIG. 6 depicts a side cross-section view of a light element (200) for a liquid vessel (100), in accordance with one embodiment. In this view, the placement of internal components (207) (details not shown) of light element (100) are positioned upon base (203) and generally filling the area within housing (201) and light dome (205), which may be comprised of a LED light piece (207*a*) and related lighting components that are known in the art. LED light piece (207*a*) of light element (200) may include lighting capabilities to produce lighting effects in a plurality of settings. Some of such settings may include, but are not limited to continuous lighting, flashing lighting, and lighting that is responsive to and produces lighting effects concurrent with the vibrations from sounds, such as music. LED light piece (207*a*) may also include lighting capabilities to produce different colors of light, including single lighting and red, green, blue ("RGB") lighting. In an exemplary embodiment, LED light piece (207*a*) may have three (3) different arrangement settings, and seven (7) different light colors to be activated in one or more of the three (3) arrangement settings depending upon a user's preference. In yet another embodiment, LED light piece (207*a*) or light element (200) may contain a wireless interface that is capable of receiving wireless signals from, for example, a venue or stadium control center for purposes of controlling the lighting effects of light element (200), including in synchronization with other vessels (100) in the proximity. Such lighting effect control or synchronization may be desired, for example, during a theme show, movie, concert, or other entertainment event.

Figure 7A:
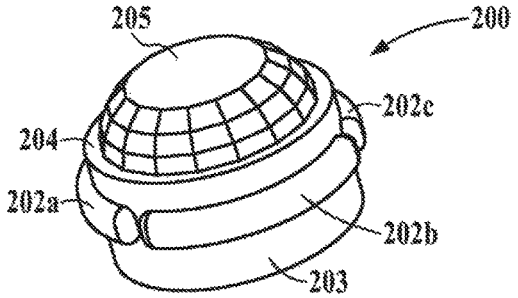
FIGS. 7A-F depict a lighting element for an illuminated liquid vessel, in accordance with another embodiment.
Figure 7B:
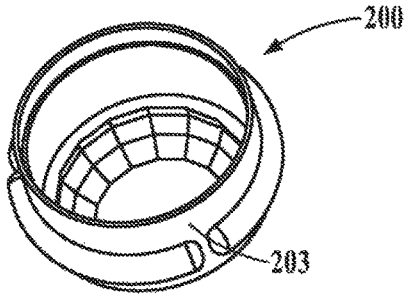
Figure 7C:
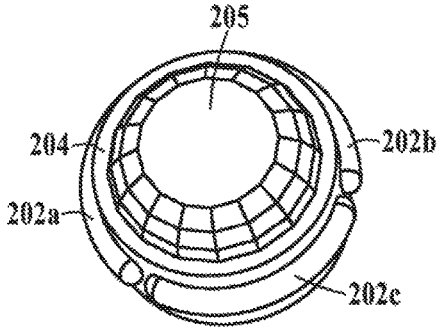
Figure 7D:
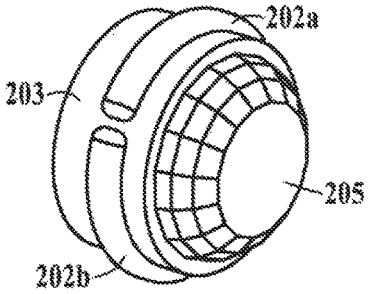
Figure 7E:
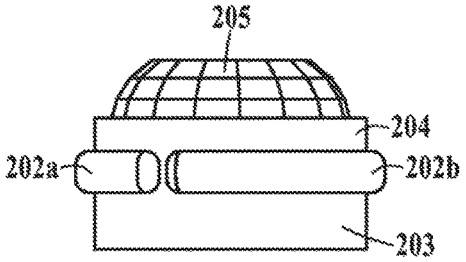
Figure 7F:
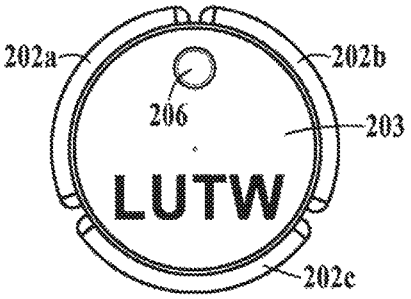

FIGS. 7A-G illustrate various representative views of another light element (200) for illuminating liquid vessel (100), in accordance with another embodiment, namely, a side perspective view of light element (200) (FIG. 7A); a bottom perspective view showing the inner portion of light element (200) (FIG. 7B); a top perspective view of light element (200) (FIG. 7C); a side perspective view of light element (200) (FIG. 7D); another side view of light element (200) (FIG. 7E); and a bottom view of light element (200) (FIG. 7F). In this embodiment, light dome (205) may be larger in size with a diameter that runs the length of a substantial portion of the diameter of top area (204).

Figure 8:
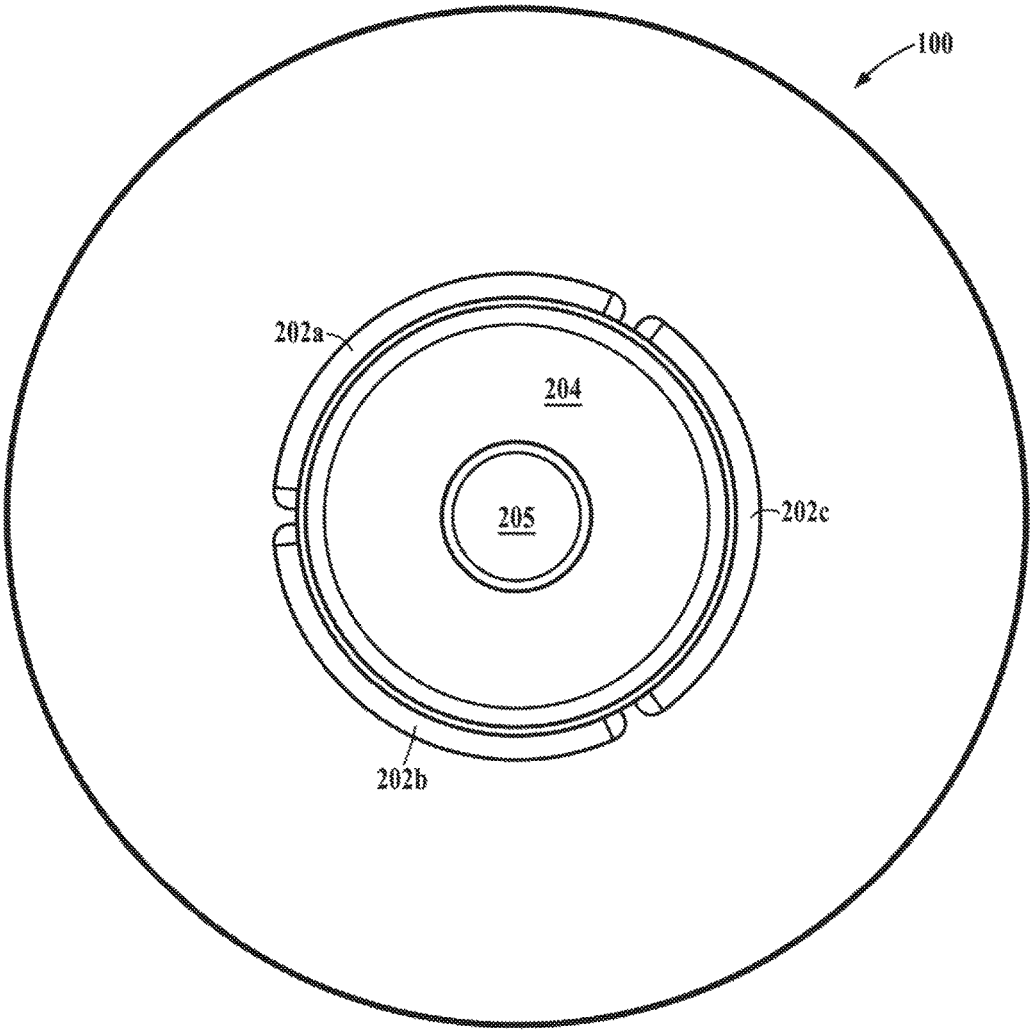
FIG. 8 depicts a top cross-sectional view of an example illuminated liquid vessel, with a lighting element configured therein.

FIG. 8 illustrates a top cross-sectional view of an exemplary liquid vessel (100) with a light element (200) configured therein. Cavity (105) is shown from above, with an exemplary light element (200) positioned within to illuminated liquid vessel (100) and its contents. As explained earlier, light element (200) may snap into cavity (105) via rib enclosures (105*a-c*), which are concave in shape in order to fit around the convex shape of ribs (202*a-c*). By snapping in or otherwise popping light element (200) into cavity (105) and its rib enclosures (105*a-c*), allows light element to be securely attached within liquid vessel (100), with rib enclosures (105*a-c*) providing light element (200) with a high level of reinforcement and stability once placed within.

Figure 9:
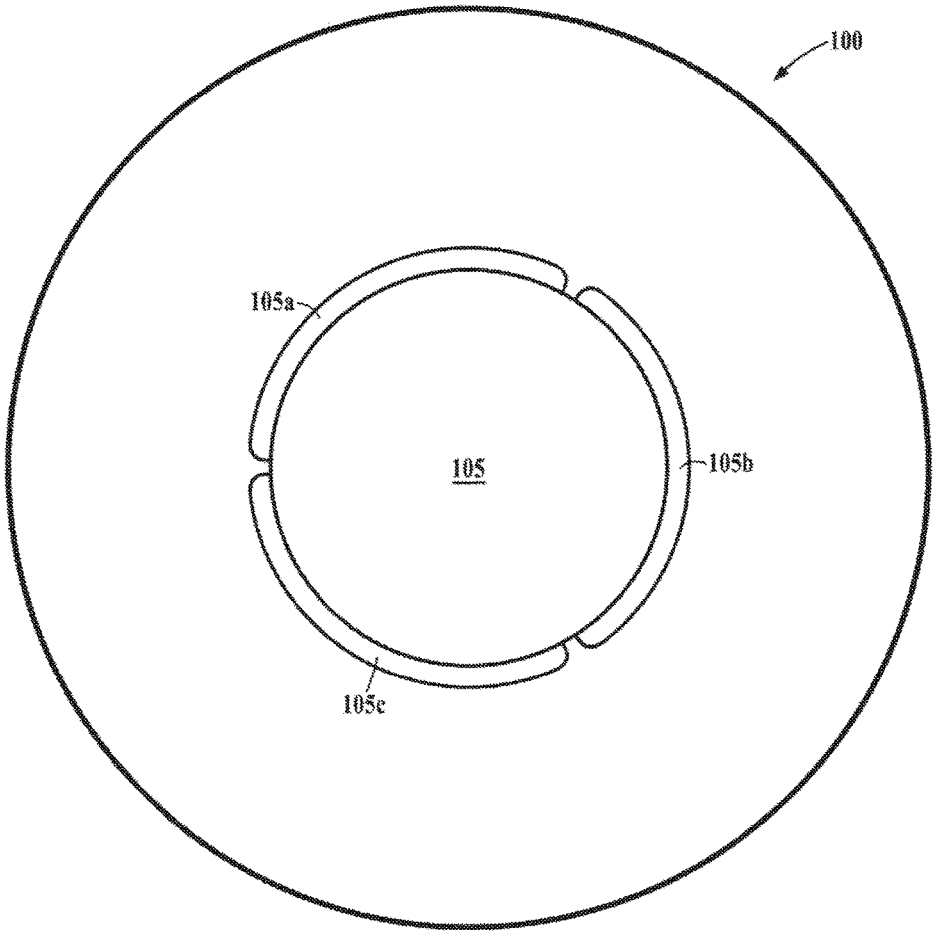
FIG. 9 depicts a top cross-sectional close-up view of an example illuminated liquid vessel, without a lighting element configured therein.

Similar to FIG. 8, FIG. 9 depicts a top cross-sectional close-up view of an example liquid vessel (100), but without a light element (200) configured therein. In this view, the shape of cavity (105) and its rib enclosures (105*a-c*) are shown in an empty state, and further illustrates cavity's (105) reinforced features, including with a thicker layer of plastic material (or other material used to make vessel (100)) for placing light element (200) thereupon. In another embodiment, cavity (105) may contain a uniform concave shaped space around the circumference of cavity (105) instead of a plurality of rib enclosures (105*a-c*) to accommodate ribs (202*a-c*), or other variations in shape that may be implemented to form ribs (202*a-c*), including as a singular uniform rib around the circumference of housing (201).

Figure 10:
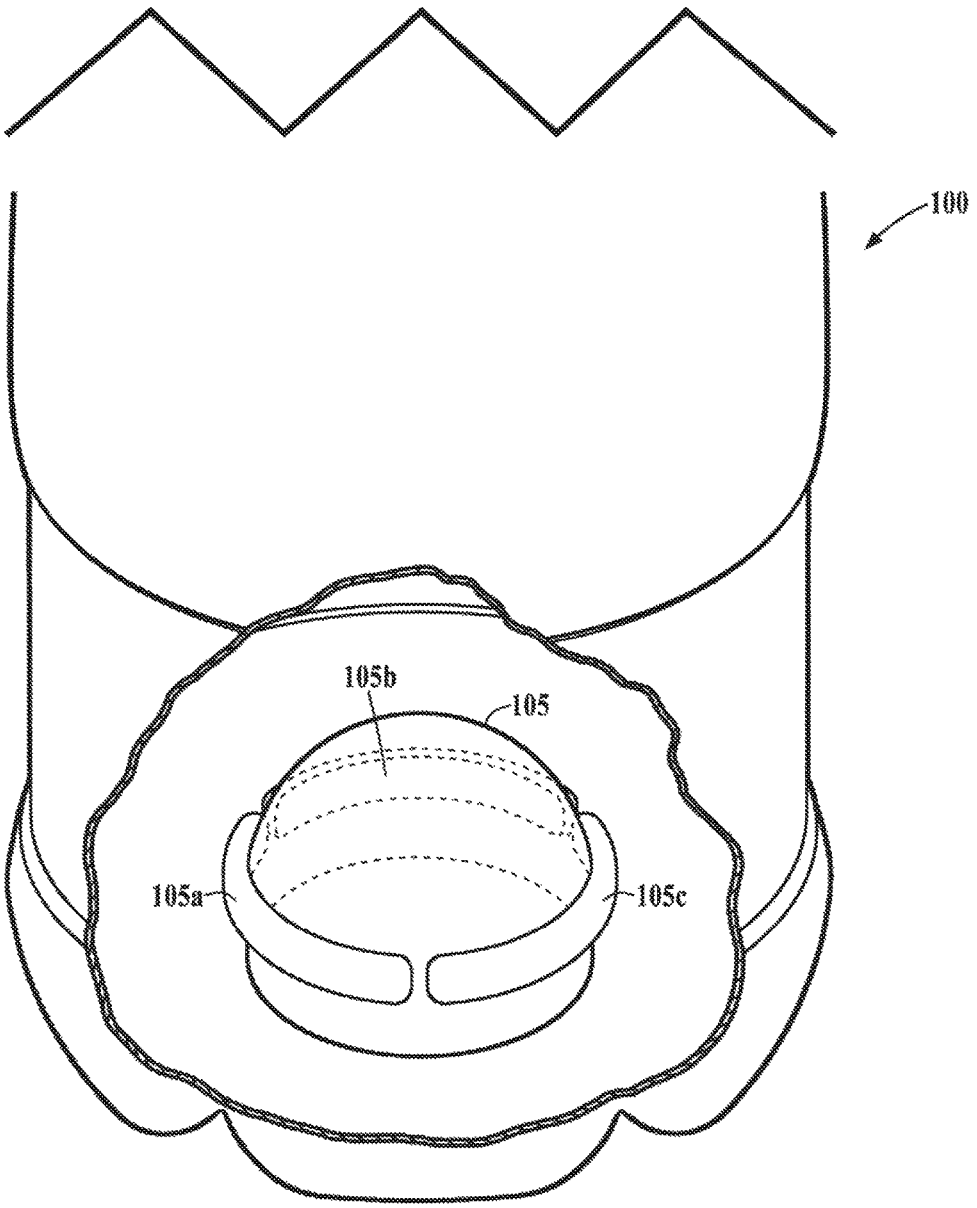
FIG. 10 depicts a side cross-sectional close-up view of an example illuminated liquid vessel, without a lighting element configured therein.

In following with FIGS. 8 and 9, FIG. 10 depicts a side cross-sectional close-up view of an example liquid vessel (100), and without a light element (200) configured therein, and depicts another view of rib enclosures (105*a-c*). The concave shape of rib enclosures (105*a-c*) may be deep enough in width to completely house the entire shape of ribs (202*a-c*) protruding from housing (201). In the present view, rib enclosures (105*a-c*) may be formed as separate elements within cavity (105), but as mentioned earlier, other embodiments may differ in shape without deviating from the scope of the present disclosure.

In another embodiment of cavity (105), cavity (105) may be both dome shaped and may contain threaded grooves around its circumference (not shown). Such threaded grooves may be complementary in shape to another embodiment of light element (200) which may contain threaded groves around it circumference. Light element (200) may be inserted and fixed into cavity (105) by screwing in light element (200) into cavity (105) via the complementary grooves of each. Light element (200) may be tightened therein, and removed such as when light element (200) may need to be replaced or changed, or removed for any other reason. Such embodiment of cavity (105) may be reinforced with additional plastic material and may be rigid in nature so that when screwing light element (200) therein, cavity (105) does not warp, deform, or otherwise collapse as a result. Further, such embodiment of cavity (105) may be used in combination with elements such as rib enclosures (105*a-c*) and other variations thereof. Similarly, such embodiment of light element (200) may contain one or more ribs (202*a-c*) and other variations thereof without limiting the scope of the present disclosure.

Figure 11:
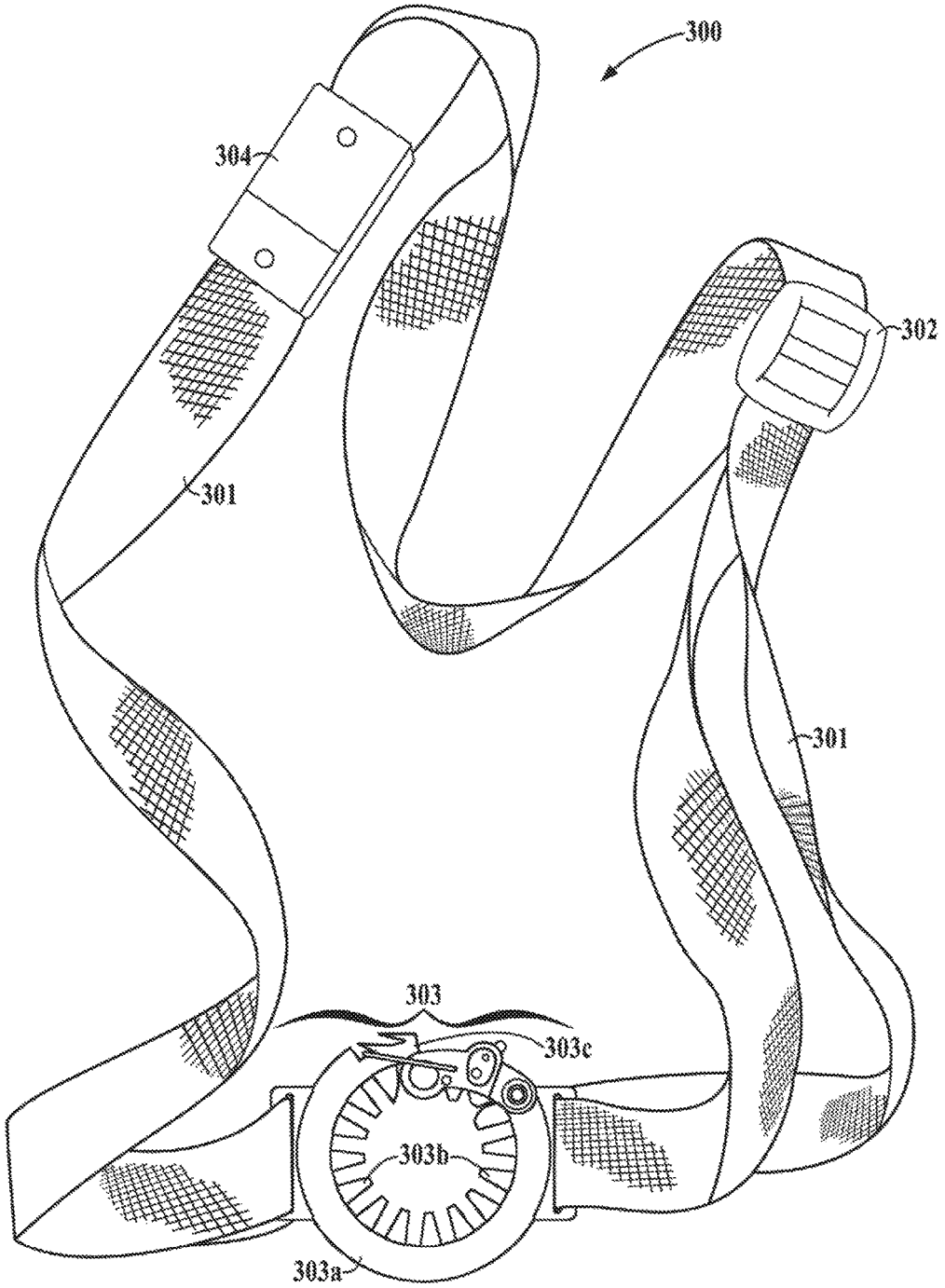
FIG. 11 depicts a perspective view of an example lanyard element for use with an example illuminated liquid vessel, in accordance with one embodiment.

FIG. 11 depicts a perspective view of an example lanyard element (300) for use with exemplary illuminated liquid vessel (100), in accordance with one embodiment. Lanyard (300) may be coupled with liquid vessel (100) when in use by a user, such as when a user is at an event or other outing, and may desire to hold liquid vessel (100) around the user's neck, shoulder, or arm. Lanyard (300) may be comprised of a collar (301) that may measure from 1-2 feet in length, or other similar lengths in order to accommodate the comfort level of a user when positioning and using lanyard (300). Collar (301) may be comprised of a sturdy, heavy duty fabric, including nylon or polyester of different weave patterns, thickness, and lengths without deviating from the scope of the present invention. Lanyard (300) may also contain an adjustable mechanism (302) for collar (301) as well as a securing element (303) for attaching lanyard (300) to the neck (102*a*) of liquid vessel (100). Securing element (303) may further comprise a solid circular ring (303*a*) that attaches to collar (301) on opposite ends of security element (303). Ring (303*a*) may contain a plurality of teeth (303*b*) positioned within its inner circumference for purposes of holding securing element (303) in place. Ring (303*a*) may also comprise an adjustable mechanism (303*c*) for opening and closing ring (303*a*), and which also enable it to be fitted around neck (102*a*), or removed from neck (102*a*). Lanyard (300) further comprises safety element (304), described in further detail in FIG. 12.

Figure 12:
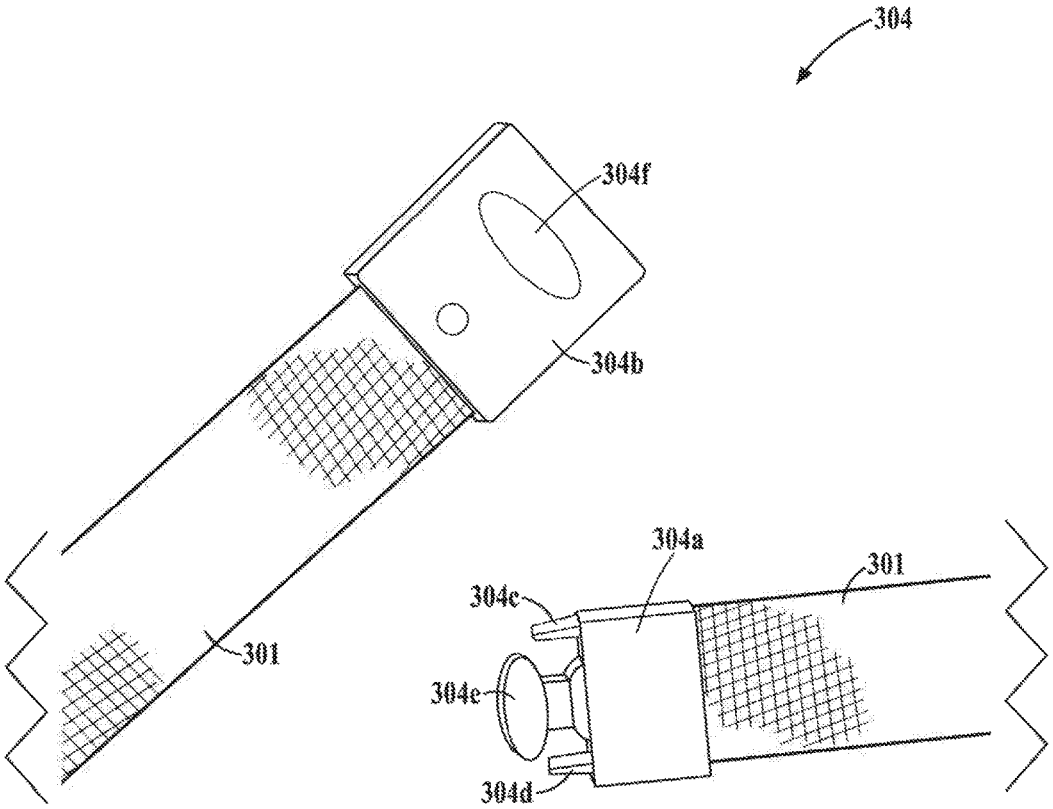
FIG. 12 depicts a close-up view of a safety element an example lanyard for use with an example illuminated liquid vessel, in accordance with one embodiment.

FIG. 12 depicts a close-up view of a safety element (304) of lanyard (300), in accordance with one embodiment. Safety element (304) may be attached to fabric collar (301) at opposite ends of safety element (304), and may be comprised of two pieces (304*a* and 304*b*) that snap together one or more inner prongs (304*c-e*). Inner prongs (304*c-e*) may be comprised of two generally rectangular inner end pieces (in this view (304*c*) and (304*d*)) and a middle oval piece (304*e*) that may secure safety piece (304*a*) into safety piece (304*b*). Piece (304*b*) contains an opening (3040 to allow a user to exert pressure on oval piece (304*e*) there within in order to remove safety piece (304*a*) from safety piece (304*b*). Also, when lanyard (300) is in use, safety piece (304*a*) may release and separate from safety piece (304*b*) on its own in the event of an emergency, such as strangulation, twisting, or other adverse movement of lanyard (300) via the exertion of pressure thereupon. Safety piece (304*a*) may release from safety piece (304*b*) or may be released when a user engages oval piece (304*e*) through opening (3040.

Figure 13:
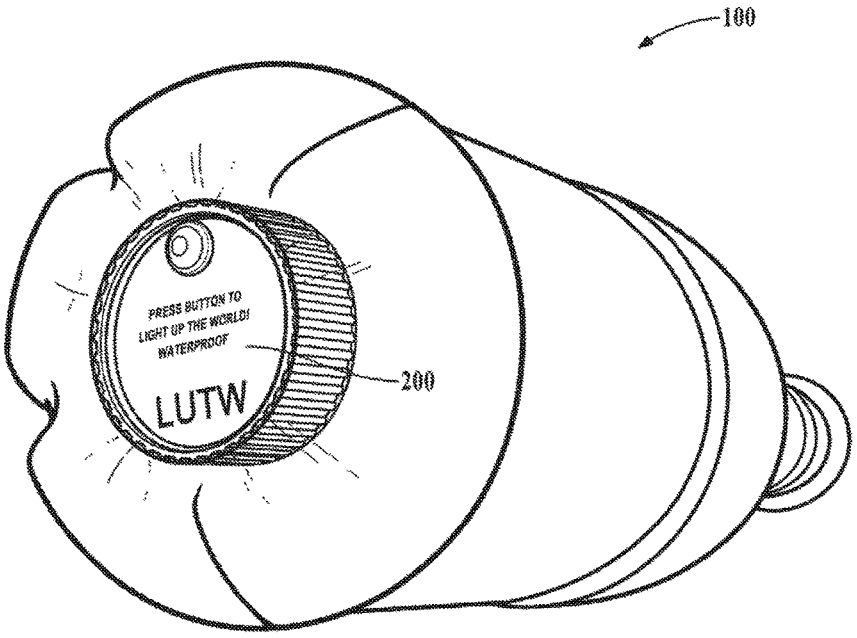
FIG. 13 illustrates a perspective view of another embodiment of an illuminated liquid vessel, with a lighting element configured within a pressure-fit cavity of the vessel, in accordance with one embodiment.

FIG. 13 illustrates a perspective view of another embodiment of an illuminated liquid vessel (100), with another embodiment of light element (200) and an alternate embodiment of cavity (105), where light element (200) is configured to fit within a recess, such as cavity (105) via a pressure fit. Cavity (105) may be situated within base (103) of vessel (100), and may be situated at a height above indentations (103*a, b, c, d*, and e). Cavity (105) may be configured as a pressure-fit cavity, in which a pressure force may be utilized to hold and retain light element (200) within vessel (100) as the overall shape of cavity (105) may be substantially similar in shape, dimension, and size as light element (200). Cavity (105) may also be configured to have an inner body that is substantially cylindrical in shape with a top portion of cavity (105) slightly tapered inwardly in shape (See FIG. 14 for additional detail). In this embodiment, cavity (105) may be formed with additional plastic material (such plastic material being a material that may be utilized for vessel (100)) so that it is reinforced as well as thicker in nature than the rest of vessel (100). In this embodiment, cavity (105) may be rigid so as to enable such pressure fit around light element (200) that is stable and may retain light element (200) therein.

When inserting light element (200) into cavity (105), the top portion of cavity (105) may be configured to slightly expand in size as light element (200) is initially pushed toward the top area of cavity (105). As light element (200) is further inserted within cavity (105), the expansion of size in cavity (105) is reduced, with the resulting reduction in size of cavity (105) creating pressure around the circumference of light element (200) to firmly hold light element (200) within cavity (105).

When light element (200) is pressure-fit within cavity (105), the top portion of cavity (105) may be positioned slightly above in height to an upper edge of light element (200*a*) so that there is a small space between the upper edge of light element (200) and the top portion of cavity (105). Such space may between light element (200) and the upper portion of cavity (105) may assist with creating a pressure, including a suction pressure, around light element (200) when inserted therein.

The resulting pressure around light element (200) may be strong enough in nature so that a user cannot manually extract or otherwise remove light element (200) from vessel (100) without having to apply a substantially high amount of force to vessel (100), or dismantling the vessel (100) altogether. Further, and as shown in this view, there may be a negligible amount of space, if any, between light element (200) and cavity (105) once light element (200) is placed therein, so as to prevent a user from being able to pry, remove, or otherwise dislodge light element (200) from cavity (105).

Figure 14:
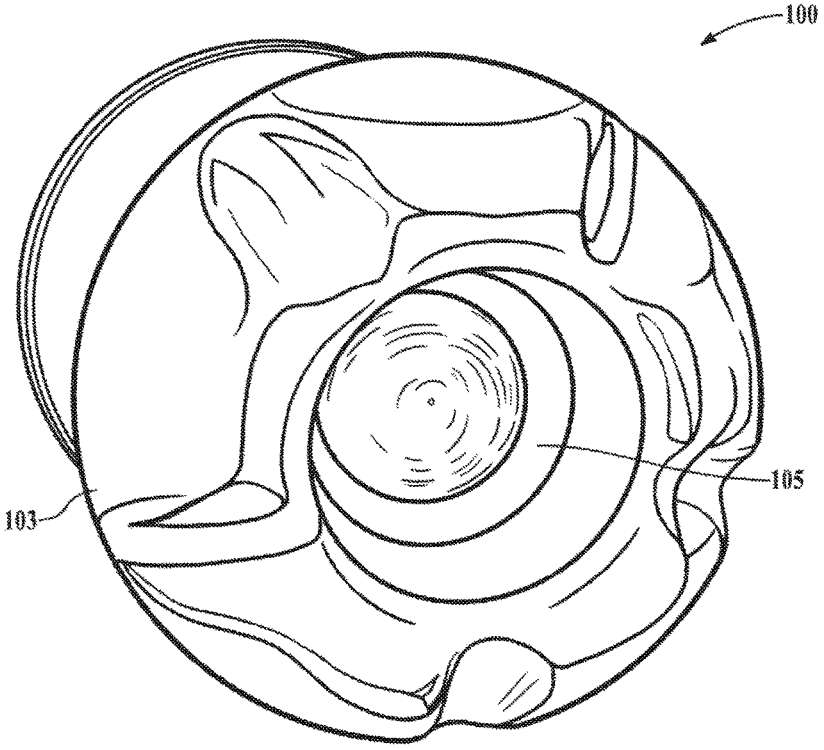
FIG. 14 illustrates a perspective view of the illuminated liquid vessel embodiment of FIG. 13, without a lighting element configured within a pressure-fit cavity of the vessel, in accordance with one embodiment.
Figure 15A:
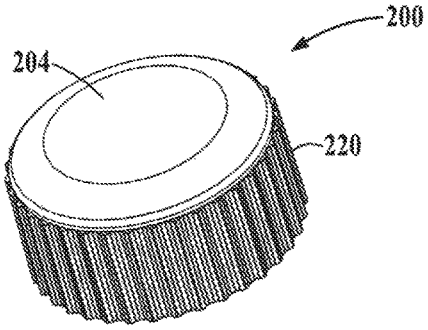
FIG. 15A-F illustrates perspective, side, top, bottom, and cross-section views of a lighting element in accordance with another embodiment.
Figure 15B:
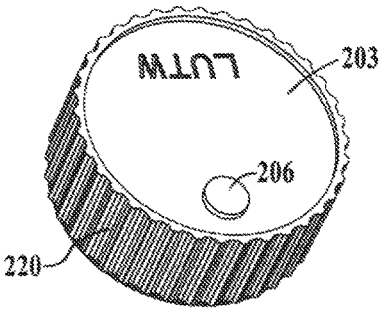
Figure 15C:
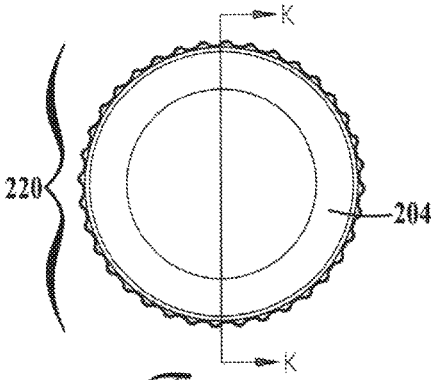
Figure 15D:
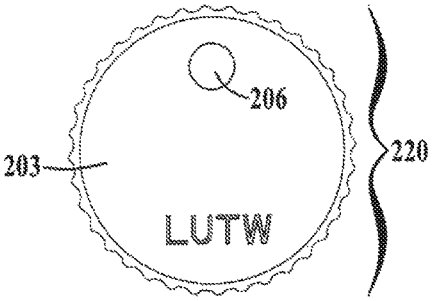
Figure 15E:
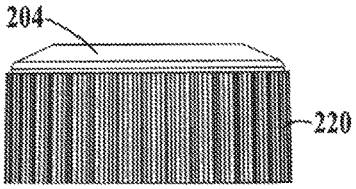
Figure 15F:
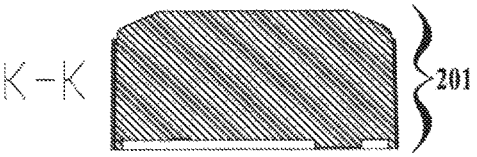

FIG. 14 illustrates a perspective view of the illuminated liquid vessel (100) embodiment of FIG. 13, without a light element (200) configured within the pressure-fit cavity (105) of the vessel (100). The generally cylindrical shape of cavity (105) is shown in this view, including its top portion which is tapered inwardly, as explained earlier.

In another embodiment of cavity (105), cavity (105) may be both cylindrical in shape and contain threaded grooves around its circumference (not shown). Such threaded grooves may be complementary in shape to another embodiment of light element (200) which may contain threaded groves around it circumference (not shown). Light element (200) may be inserted and fixed into cavity (105) by screwing in light element (200) into cavity (105) via the complementary grooves of each cavity (105) and light element (200). Light element (200) may be tightened therein, and removed such as when light element (200) may need to be replaced or changed, or removed for any other reason. Such embodiment of cavity (105) may be reinforced with additional plastic material and may be rigid in nature so that when screwing light element (200) therein, cavity (105) does not warp, deform, or otherwise collapse as a result. Further, such embodiment of cavity (105) may be used in combination with elements such as rib enclosures (105*a-c*) and other variations thereof. Similarly, such embodiment of light element (200) may contain one or more ribs (202*a-c*) and other variations thereof without limiting the scope of the present disclosure.

FIG. 15A-F illustrate the various perspective, side, top, bottom, and cross-section views of another embodiment of light element (200) that is configured to fit within vessel (100) via a pressure fit/force as discussed earlier with respect to FIGS. 13 and 14. Such pressure force allows light element (200) to fit within cavity (105) without the need for adhesives, or external retaining mechanisms.

In this embodiment of light element (200), light element (200) is substantially cylindrical in shape, and may be slightly tapered or slanted in shape toward a top portion (204) of light element (200). In this embodiment, top portion (204) may be substantially planar in shape excepting such area that is slightly tapered or slanted in shape. Around the circumference of housing (201) of light element (200) are a series of ridges (220) that are positioned vertically around light element (200) (See FIGS. 15 A-F for additional detail). As indicated earlier, housing (201) may contain the internal lighting components that are known in the industry.

Ridges (220) surround the entire circumference of the housing (201) of light element (200), and may be slightly rounded in nature (See FIG. 5C). Ridges (220) may serve to further reinforce the pressure fit of light element (200) within cavity (105), including by creating an additional layer of friction between light element (200) and vessel (100) when light element (200) is inserted into cavity (105). Ridges (220) may also prevent light element (200) moving within cavity (105) as well as from rotating therein. Other variations in the shape of ridges (220) may be utilized in connection with the present embodiment without deviating in scope from the present invention.

Various aspects of the present invention are described herein with reference to illustrations and/or diagrams according to embodiments of the invention. While particular forms of the invention have been illustrated and described, it will also be apparent to those skilled in the art that various modifications can be made without departing from the spirit and scope of the invention. Accordingly, it is not intended that the invention be limited except by the claims.

The invention claimed is:

1. An illuminable container device, comprising:

a housing for containing a liquid;

a dome shaped recess configured within a base area of said housing, with said recess extending upwardly into said housing;

wherein said dome shaped recess comprises a plurality of sub-recesses situated around substantially all of a lower circumference area of said dome shaped recess and that extend laterally into said housing;

wherein each sub-recess encompasses approximately one-third of the lower circumference area of the dome shaped recess;

further wherein, each sub-recess is curved outwardly along its length that extends laterally into said housing, with each opposite end width of each sub-recess tapered off in a curved shape;

a light device, comprising a light housing that is substantially cylindrical in shape with a miniature dome situated at a center of a top area of said light device;

said light housing comprising a plurality of ribs situated around a circumference of said light housing; and said plurality of ribs are configured to complementarily fit within said plurality of sub-recesses of said dome shaped recess;

wherein each rib of said light housing covers approximately one-third of the lower circumference area of said light housing;

wherein, each rib is curved outwardly along its length that is furthest from the circumference of said light housing, and further wherein, each rib is curved flush against the circumference of said light housing along its length that is closest to said light housing;

and further wherein, each opposite end width of each rib is tapered off in a curved shape.

2. The device of claim 1, wherein said plurality of ribs further comprises a set of three ribs.

3. The device of claim 1, wherein said plurality of sub-recesses further comprise a set of three sub-recesses.

4. The device of claim 1, wherein said housing is comprised of a recyclable plastic material.

5. The device of claim 1, wherein said light device is configured for multi-setting lighting configurations.

6. An illuminable container device, comprising:

a housing for containing a liquid;

a recess configured within a base area of said housing, with said recess extending upwardly into said housing and in a substantially cylindrical shape;

wherein said recess is comprised of a rigid material;

a light device, comprising a light housing with a substantially cylindrical shape, said light housing comprising a plurality of ridges positioned vertically around a circumference of said light housing;

said light device configured to fit into and substantially fill said recess being held therein by a pressurized fit without the use of any interconnectable, interlocking, or fastening attachment means to said plurality of ridges;

wherein said plurality of ridges are slightly curved in shape along their lengths that are touching said recess and further wherein said plurality of ridges are configured to stabilize said light device within said recess.

7. The device of claim 6, wherein said housing is comprised of a recyclable plastic material.

8. The device of claim 7, wherein said recess is reinforced with a thicker layer of said recyclable plastic material.

9. The device of claim 6, wherein said recess is substantially the same in shape as said light device.

10. The device of claim 6, wherein said light device is configured for multi-setting lighting configurations.

11. A wearable illuminable container device, comprising:

a housing for containing a liquid;

a recess configured within a base area of said housing, with said recess extending upwardly into said housing and in a substantially cylindrical shape;

a light device, comprising a light housing with a substantially cylindrical shape, said light housing comprising a plurality of ridges, which are positioned vertically around a circumference of said light housing, said plurality of ridges being curved in nature along their lengths that are touching said recess;

said light device configured to fit into and substantially fill said recess being held therein by a pressurized fit without the use of any interconnectable, interlocking, or fastening attachment means to said plurality of ridges; and a lanyard configured to couple around said device by an adjustable multi-prong securing element;

wherein said adjustable multi-prong securing element is further comprised of a plurality of teeth configured in a circular set for attachment around a neck portion of said housing.

12. The device of claim 11, wherein said lanyard further comprises a safety element.

13. The device of claim 12, wherein said safety element further comprises a plurality of complementary snaps configured to uncouple when subjected to a substantial amount of force.

* * * * *